US009850654B2

(12) United States Patent
Shalev

(10) Patent No.: US 9,850,654 B2
(45) Date of Patent: Dec. 26, 2017

(54) SYSTEM AND METHOD FOR DENSELY PACKED EASILY TRANSPORTABLE MOBILE STRUCTURES

(71) Applicant: Shaul Shalev, GY Savyon (IL)

(72) Inventor: Shaul Shalev, GY Savyon (IL)

( * ) Notice: Subject to any disclaimer, the term of this patent is extended or adjusted under 35 U.S.C. 154(b) by 242 days.

(21) Appl. No.: 14/371,442

(22) PCT Filed: Jan. 10, 2013

(86) PCT No.: PCT/IB2013/050216
§ 371 (c)(1),
(2) Date: Jul. 10, 2014

(87) PCT Pub. No.: WO2013/105044
PCT Pub. Date: Jul. 18, 2013

(65) Prior Publication Data

US 2015/0000215 A1 Jan. 1, 2015

Related U.S. Application Data

(60) Provisional application No. 61/585,259, filed on Jan. 11, 2012.

(51) Int. Cl.
*E04B 1/346* (2006.01)
*E04B 7/16* (2006.01)
(Continued)

(52) U.S. Cl.
CPC ..... *E04B 1/34305* (2013.01); *E04B 1/3431* (2013.01); *E04H 1/005* (2013.01);
(Continued)

(58) Field of Classification Search
USPC ..... 52/67, 79.2, 79.4, 79.5
See application file for complete search history.

(56) References Cited

U.S. PATENT DOCUMENTS 2,827,004 A * 3/1958 Luce et al. ..... 109/1 S
3,833,954 A * 9/1974 Daughenbaugh et al. ... 296/171
(Continued)

OTHER PUBLICATIONS

Definition of "separable" provided by dictionary.com at: http://dictionary.reference.com/browse/separable?s=t.*

*Primary Examiner* — Brian D Mattei
(74) *Attorney, Agent, or Firm* — Mark M. Friedman

(57) ABSTRACT

It is disclosed a densely packable sequential series of external housing units associated with succeeding internal housing units. The external housing units have inside volume and openings for receiving the internal housing unit. Means for facilitating the displacement of an internal unit out of an external unit, like integrated bearings, integrated wheels, integrated retractable wheels, and a low friction coating are installed on an inside shells of the associated external housing unit, on an outside shells of the internal housing unit. The housing units have a uniform cross section along a majority of one of the dimensions of the unit, having outlines like a circle, a triangular frame, a rectangular frame, a circular arc of, a trapezoidal frame, a polygon of five, six or more edges, a hyperbolic arc, and a parabolic arc, or other types of arches. The typical transverse linear size of an internal unit is 80% to 99% of the preceding external unit. The series is transportable as a single cargo item between locations. A shell of an housing unit may include at least one layer like highly insulating layer, anti-ballistic layer, and composite materials such as fiberglass reinforced plastic layer, polymer-metal composite layer, and carbon based composite materials.

20 Claims, 11 Drawing Sheets

(51) Int. Cl.

| | |
|---|---|
| ***E04B 1/343*** | (2006.01) |
| ***E04H 1/00*** | (2006.01) |
| ***E04H 1/12*** | (2006.01) |
| ***E04H 9/00*** | (2006.01) |
| ***E04H 9/04*** | (2006.01) |
| *E04B 1/32* | (2006.01) |
| *E04B 1/00* | (2006.01) |

(52) U.S. Cl.
CPC ..... *E04H 1/12* (2013.01); *E04H 9/00* (2013.01); *E04H 9/04* (2013.01); *E04B 1/3205* (2013.01); *E04B 1/3211* (2013.01); *E04B 2001/0053* (2013.01)

(56) References Cited

U.S. PATENT DOCUMENTS

| | | | | |
|---|---|---|---|---|
| 5,732,839 | A * | 3/1998 | Schimmang et al. | 220/1.5 |
| 5,797,224 | A * | 8/1998 | Gunthardt | 52/79.4 |
| 5,832,676 | A * | 11/1998 | Gillmore et al. | 52/67 |
| 6,151,840 | A * | 11/2000 | Simison | 52/67 |
| 8,756,876 | B1 * | 6/2014 | Orr | 52/86 |
| 2004/0216395 | A1 * | 11/2004 | Wentworth, Jr. | 52/79.5 |
| 2012/0151851 | A1 * | 6/2012 | Cantin et al. | 52/79.5 |
| 2012/0167484 | A1 * | 7/2012 | Bernard | 52/79.5 |

* cited by examiner

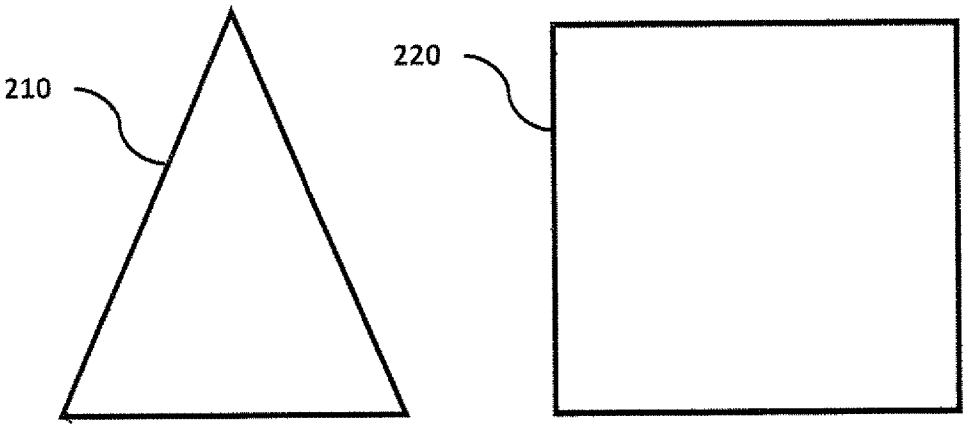
Fig. 2a
Fig. 2b
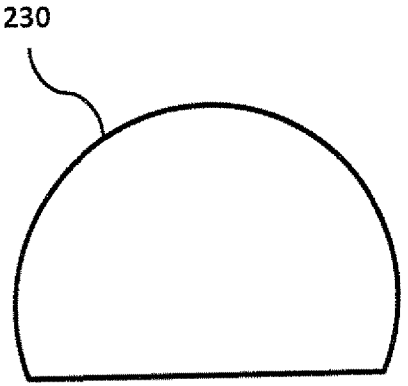
Fig. 2c
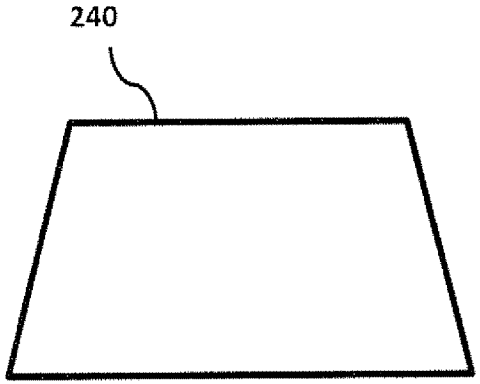
Fig. 2d
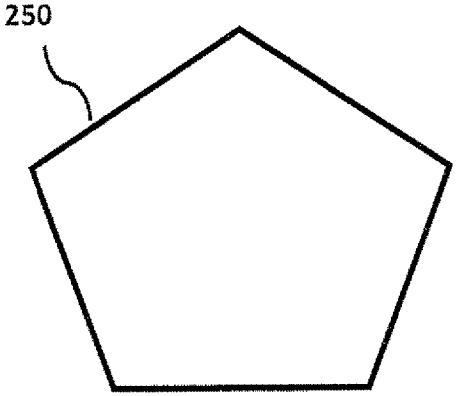
Fig. 2e
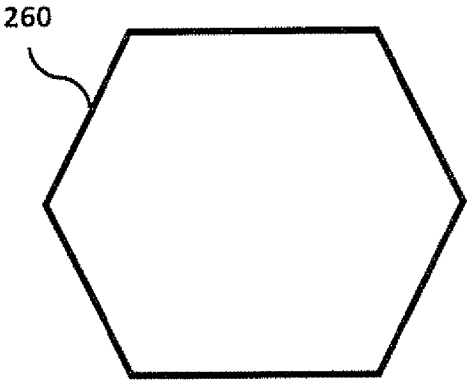
Fig. 2f

SYSTEM AND METHOD FOR DENSELY PACKED EASILY TRANSPORTABLE MOBILE STRUCTURES

BACKGROUND OF THE INVENTION

Field of the Invention

The current invention is in the general field of providing light weight, highly resistant and promptly deployable structures, particularly useful for post disaster regions, and for provisioning of easily transportable temporary living, work and storage environment at all weather conditions.

Description of Related Art

It is necessary to provide living environments for sustaining harsh weather conditions at non-populated regions or at regions which suffered disasters like earth-quakes, flooding, fires, and wars. Thus, governments required to manage disaster zones request international help during and immediately after such disasters. Such requests are focused on the supply of reasonably protected living facilities for the population at the relevant zones, as well as for rescue and event management teams.

However, the provisioning of appropriate living environments is usually connected with a complicated logistic operation relying on trucking or on air-transportation of relevant structures. Tents or other types of foldable structures can be delivered in a relatively densely packed form. Yet, such foldable structures require on-site building process, and in many cases they fail to provide reasonable living environment under harsh weather conditions or when further disasters are expected after deployment. On the other hand, fully or partially built structures for sustaining "all weather" conditions have volume and weight that require a heavy truck or a very heavy helicopter for the delivery of each single structure to a deployment site.

BRIEF SUMMARY OF THE INVENTION

The current invention aims at provisioning light-weight structures which are almost fully built prior to transportation, designed to enable the supply of a plurality of independent protected living environments, which are easily transportable and are usable under extremely harsh conditions at a deployment site. The proposed solution is modularly and cost-effectively designed for a variety of theatres, areas under or after storms or other natural or manmade disasters, and contaminated areas due to severe industrial pollution or NBC (nuclear biological, and chemical) war hazards, for example. Moreover, the proposed lightweight structures are practically built away from their deployment site, but their design enables transportation, of a densely packed single cargo containing several independently deployable structures, utilizing a single medium size truck or a single helicopter.

It is disclosed according to certain preferred embodiments of the present invention, a densely packable sequential series of external housing units associated with succeeding internal housing units. The external housing units have inside volume and openings for receiving the internal housing units. The units include means for facilitating the displacement of internal housing units relative to the associated external housing units.

In some embodiments, the series has one, two, three or more intermediate housing units serving both as an internal unit associated with a preceding external unit and as an external unit associated with a succeeding internal housing unit.

In some embodiments, housing units have a uniform cross section along a majority one of the dimensions of the unit. Exemplary outlines of a uniform cross section are a circle, a triangular frame, a rectangular frame, a circular arc, a trapezoidal frame, a polygon of five, six or more edges, a hyperbolic arc, a parabolic arc and other types of arches. In a preferred embodiment, a certain external housing unit has a first uniform cross section, and an associated internal housing unit has a second uniform cross section. The second uniform cross section is substantially similar in shape to the first uniform cross section, and a linear scale of the second uniform cross section is 30% to 99.5% of a respective linear scale of the first uniform cross section. Preferably, the linear scale of the second uniform cross section is 80% to 99% of the respective linear scale of the first uniform cross section.

Exemplary means for facilitating the displacement are means installed on an inside bottom of the associated external housing unit, means installed on an outside bottom of the at least one internal housing unit, integrated bearings, integrated wheels, a set of integrated retractable wheels, and low friction coatings.

In some embodiments, the series is transportable as a single cargo item from a certain location to a desired deploying or storage location.

In some embodiments, a shell of a housing unit includes layers like constructive layers, highly insulating layer, anti-ballistic layer, and composite materials such as fiberglass reinforced plastic layer, polymer-metal composite layer, and carbon based composite materials.

In some embodiments, a shell of a housing unit includes a certain combination of layers and one or more substantially sealable openings such as to provide certain internal conditions at predetermined environmental conditions.

In some embodiments, mounts are installed on shells of an housing unit before packing such as to not interfere the dense packing of the series. Exemplary mounts are horizontal floor mounts installed on an inside shell such as to allow installment of a floor in the housing unit, wall mounts for a power source, for a power control system, for an air condition system, for a temperature control system, for humidity control system, for equipment as required to the users of the housing units, for means for isolating an internal space of the certain housing unit from an internal, or external space of an adjacent housing unit. Other possible wall mounts are installed on an inside shell of the certain housing unit for assembling surfaces on the inner shell. Exemplary surfaces are thermal insulating surfaces, armored surfaces, acoustic isolating surfaces, and surfaces customized for storage.

In some embodiments, external housing units have doors for receiving and displacing internal housing units.

In some embodiments, intermediate layers are disposed between shell of a certain external housing unit and a shell of an associated internal housing unit. Upon deployment of the series, the certain external housing unit and the associated internal housing unit remain together such as to have a combined housing unit having a combined shell of at least three layers.

It is disclosed according to certain preferred embodiments of the present invention, a method for using a densely packed sequential series of external housing units associated with succeeding internal housing units. The method includes a step of storing the series such that a volume accommodated by the series having substantially the same size as a storage volume required for accommodating a most external unit of the series. Additional steps are a step of transporting the series as a single cargo item from a certain location to a destined location, and manipulating openings for allowing displacing of internal housing units relative to associated external units. Another step of the method is displacing the internal housing units from the associated external housing units, such that the inside volume of the at least one external units being available for activities other than storing the internal housing units.

In some embodiments, the method includes a step of connecting an internal housing unit to an associated external housing unit after its majority is displaced out of the associated external housing unit. The connection may be a sealable connection isolating a combined volume of the connected housing units from external environment. The connection may include an opening or a door in a first housing unit for connection with a second housing unit. Also, a blocking means may exist between an internal volume of an internal housing unit and the associated external unit.

For enabling dense packing, a variety of installing steps may be executed before the dense packing. Exemplary installments are installment of horizontal floor mounts on an inside shell of an housing unit such as to allow installment of a floor therein, installment of wall mounts on a shell of the certain housing unit for assembling surfaces on the inner shell, and installment of parts of a variety of subsystems.

The dense packing is further enhanced by steps like storing inside a most internal housing unit modules for installing on the housing units after deployment, installing a module on a certain housing unit after the displacing, disassembling it to allow dense repacking of the certain housing unit with another housing unit, and installing a module on a certain housing unit before packing provided that it does not interfere the dense packing of the series.

BRIEF DESCRIPTION OF THE DRAWINGS

The subject matter regarded as the invention is particularly pointed out and distinctly claimed in the concluding portion of the specification. The invention, however, both as to system organization and method of operation, together with features and advantages thereof, may best be understood by reference to the following detailed description when read with the accompanied drawings in which:

FIG. 2*a*, FIG. 2*b*, FIG. 2*c*, FIG. 2*d*, FIG. 2*e* and FIG. 2*f* show uniform cross sections having, respectively, triangular, rectangular, circular arc, trapezoidal, pentagonal, and hexagonal outlines.

DETAILED DESCRIPTION OF THE INVENTION

Figure 1B:
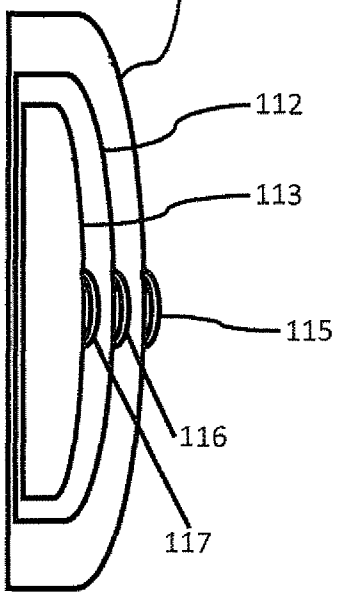
FIG. 1*b* depicts series of covers of the cylindrical housing units of FIG. 1*a*.

The present invention will now be described in terms of specific example embodiments. It is to be understood that the invention is not limited to the example embodiments disclosed. It should also be understood that not every feature of the methods and systems handling the described series is necessary to implement the invention as claimed in any particular one of the appended claims. Various elements and features of devices are described to fully enable the invention. It should also be understood that throughout this disclosure, where a method is shown or described, the steps of the method may be performed in any order or simultaneously, unless it is clear from the context that one step depends on another being performed first.

Before explaining several embodiments of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Unless otherwise defined, all technical and scientific terms used herein have the same meaning as commonly understood by one of ordinary skill in the art to which this invention belongs. The systems, methods, and examples provided herein are illustrative only and not intended to be limiting.

In the description and claims of the present application, each of the verbs "comprise", "include" and "have", and conjugates thereof, are used to indicate that the object or objects of the verb are not necessarily a complete listing of members, components, elements or parts of the subject or subjects of the verb. Here are three definitions for terms used intensively throughout the description:

Housing unit—a structure for human or domesticated animal activities like getting in and out, sitting, sleeping, eating, storage, provisioning of medical services, educational activities, operation management, etc.

Composite materials—are engineered materials made from constituent materials with significantly different physical or chemical properties. The constituent materials remain separate and distinct within the finished structure.

Wall mount—a piece of a strong material like a metal for holding an article on a wall, or a structural detail like a slot or connecting device for hanging or connecting an article on or to a wall.

In general, the proposed system is based on design, production and field deployment of a series of relatively light-weight structures or housing units, easily deployable as temporary living, working or storage environments. Typically, the series of structures is based on substantially concentric packable set of elements. The entire series or a subseries thereof may be are transported to a destination as a single cargo item. The system modular design enables customization of the series of structures for a specific event or application, by modifying the series elements to the exact needs of the users as dictated by circumstantial requirements. The customization is enabled by employing the series' units either as individual structures or as a group of several elements substantially concentrically, partially or fully unpacked. In the second case, the accumulated features of such a group support the deployment goals. Also, the installment of components and modules required for achieving environmental conditions is postponed to the time after deployment in order to enable the densely packable formation.

Design consideration of the series, aimed at achieving high and cost effective protection level in view of harsh environmental conditions, include:

- Use of easily sealable, light weight materials such as modern composite materials.
- high mechanical strength by using bodies having cylindrical, polygonal or arch based symmetries, and curved caps at both ends.
- Use of "off-the-shelf" easily sealable high diameter transportation tubes and storage tanks which are currently producible, particularly for the fluid and gas conduction and storage industries at up to 4-5 m diameter, and are produced from light weight materials such as Fiberglass Reinforced Plastics (FRP).
- Use of production facilities of transportation tubes and storage tanks, whereas only minor customization is needed for serial production of the housing structures, focusing mainly on the exact shape of the produced housing units.
- The sealable connectivity of structures having the substantially similar and substantially uniform cross-section and in particular structures made of polymeric, composite materials, metallic materials and combination thereof.
- A recent breakthrough in insulation by nano-materials which allows using insulation layers of several millimeters thickness to achieve an insulation level obtainable in the past by a several centimeters thickness.
- Modern air-filtering systems allow maintaining high quality breathable dry air at reasonable temperature within sealable structures.

Structural Design of a Series of Housing Units (FIGS. 1-3)

Figure 1A:
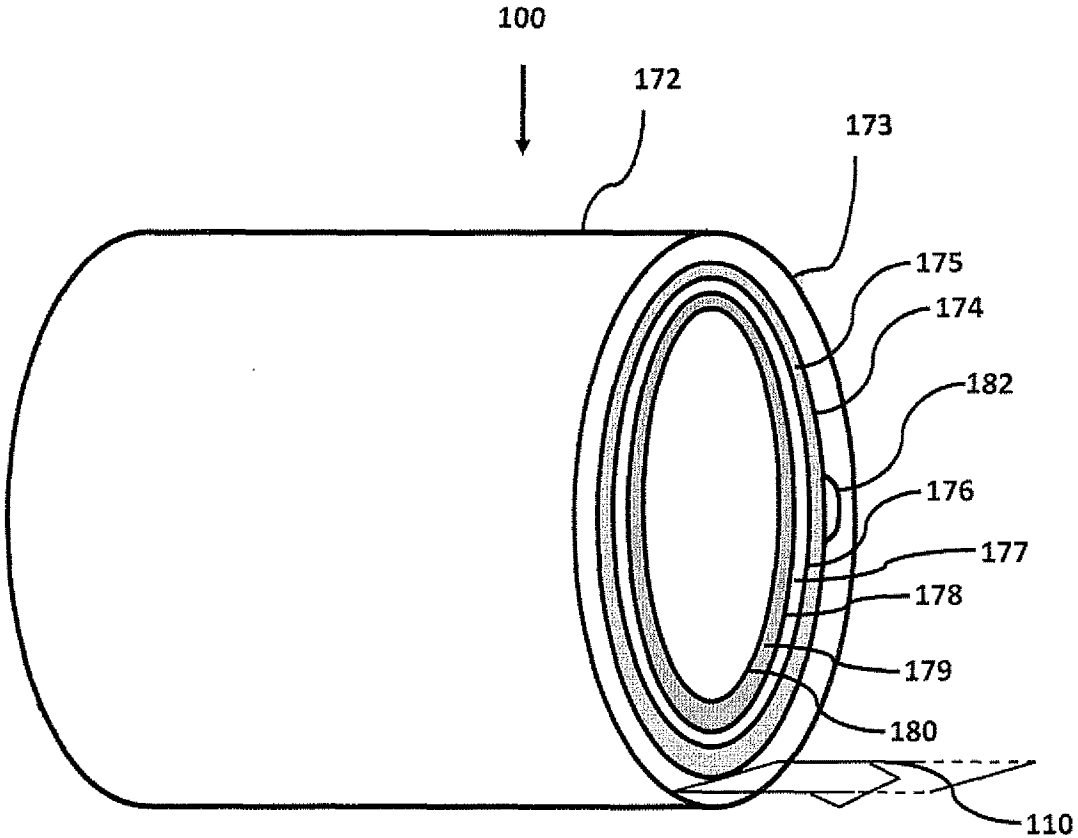
FIG. 1*a* illustrates a series of densely packed cylindrical housing units.

Reference is now made to FIG. 1*a* which presents a densely packed sequential series 100 of external housing units 172 and 175 associated respectively with succeeding internal housing units 175 and 179. The external housing units 172, and 175 have each inside volume and opening for receiving the respective internal housing units 175 and 179. Internal housing unit 175, for example, includes handle 182 for its displacement relative to the associated external housing unit 172.

In FIG. 1*a*, an intermediate housing units 175, serves both as an internal unit associated with a preceding external unit and as an external unit associated with a succeeding internal housing unit.

Preferably, in transition from an external housing unit to a succeeding internal unit, the diameter of the internal unit is reduced to 40% to 99.5% of the respective diameter of the associate external housing unit. More preferably, this reduction factor is between 80% and 99%, and most preferably it is between 90% and 98%.

The series is transportable as a single cargo item from a certain location to a desired deploying location. For that sake, caps 111, 112 and 113 of FIG. 1*b* are mounted on the corresponding housing units. The capping can be designed to be based on removable caps or caps that are operable as doors, such that in an open state they allow the displacement of internal units relative to the associated external units containing them. In special, cap 111 of the outermost housing unit 172 is tightly integrated to the main body of unit 172. If transportation specifications permit, internal caps 112 and 113 may be left in place without sealing, such that they should be removed or opened easily from the main bodies of the housing units during deployment. Handles 115, 116 and 117 of respective caps 111,112 and 113 provide their convenient gripping and displacement.

An housing unit may have either a single shell or a non-single shell. In the example of FIG. 1*a* external housing unit 172 has a single shell 173, while housing unit 175 has an outer shell 174 and an inner shell 176. A shell of an housing unit may include layers like highly insulating layer, anti-ballistic layer, and composite materials such as fiberglass reinforced plastic layer, polymer-metal composite layer, and carbon based composite materials. Also, to provide certain internal conditions at predetermined environmental conditions, a shell of an housing unit may include a combination of layers and openings having excellent sealability.

In addition, a buffer layer 177 may be disposed between succeeding housing unit 175 and 179, when unit 179 is a double shell unit based on shells 179 and 180. Such a buffer layer is useful in the deployment of the series when housing units 175 remain fully or partially inside unit 179 for providing excess protection against environmental conditions. That option is further elaborated below.

Figure 1C:
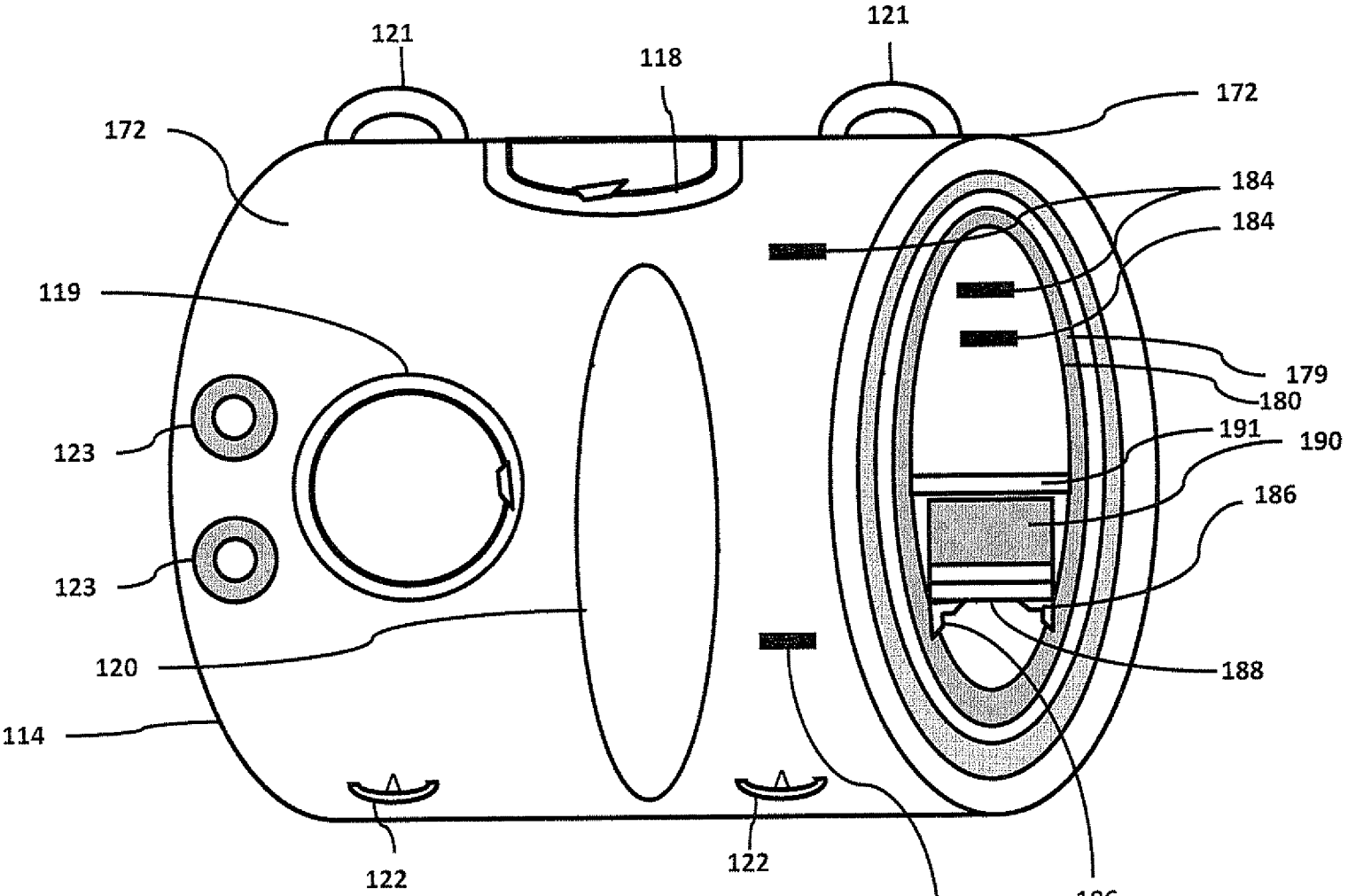
FIG. 1*c* illustrates a series of densely packed cylindrical housing units installed with a variety of mounts and accessories.

As shown in FIG. 1*c*, mounts 184 are installed on the inside side of a shell 180 of housing unit 179 or the shell 173 of unit 172 such that it does not interfere the dense packing of the series. More specifically, an internal housing unit may be inserted within housing unit 179, contained by the shell 180, or unit 172 can be inserted into a bigger associated external unit, despite installed mounts 184. Mounts 186 are horizontal floor mounts installed on the inside shell to allow installment of a floor 188 in housing unit 179. In the packed series, the floors for several housing unit may be stored within the most internal housing unit, such that upon deployment, the cap or door of the most internal unit is removed or opened, the floors are taken out and quickly installed on the relevant housing units.

Additional wall mounts 184 are installed for a power source, for a power control system, for an air condition system, for a temperature control system, for humidity control system, and for means for isolating an internal space of the certain housing unit from an internal space of an adjacent housing unit.

Furthermore, mounts like mount 184 are installed for assembling surfaces on the shell. Exemplary surfaces are thermal insulating surfaces, power sources such as solar power generators, armored surfaces, acoustic isolating surfaces, and surfaces customized for storage.

When the unloading/uploading of elements from the packed series is conducted in relatively rough terrain, there might be a need for a flat surface in front of the "feeding opening" of the element through which the loading process is managed. The required flat surface may be packed outside the housing unit series, be made from parts of a transportation flat surface used during delivery process. Alternatively, the above mentioned floors of the housing units may be used for that sake.

Each deployment cycle of a given set of structures starts with accumulating the relevant elements into a substantially concentric series for transportation in a form of a single cargo. The accumulation can be either packing of relevant elements into the required series, or unpacking unnecessary elements from a packed series or a combination of the two activities. Such preparation of the deployable series includes preparation of relevant openings of elements that are aimed to be deployed as a subseries so that the integrated group will have joint open-able and sealable openings as planned.

Each deployable series may include modules and components that are designed to be integrated after deployment, including walls, furniture items, subsystems as required to control temperature, electricity, clean air, water etc. The relevant internal components and modules belonging to each of the independently deployed element or subseries should be accumulated, marked and packed. Some or all of such modules and components can be placed internal to the most internal housing unit.

An example for such internal storage is given in FIG. 1*c* wherein floor 188 is disposed on floor mounts 186, and serves as a basis for stored components 190 and 191. In addition, certain components and modules required for the deployment may be packed outside the outermost housing unit, or in gaps between external and associated internal units when their overall size is significantly different (not shown).

Once the series forming the deployed system is fully packed, the external housing unit can be lifted and tied to its transportation platform using lifting levers 121, and placement levers 122. Levers 121 and 122 may be also used during unpacking, final placement and anchoring of the housing units at the deployment site.

Housing unit 172, has a wall or cap 114 which may include a door or window openings (not shown) or even a secondary packing/unpacking opening for displacing the internal units. All internal units may have wall or cap having the same functionality as 114, but when it is designed as a cap it can be totally removed when the series is packed, as will be explained later. Unit 172 may also have other openings like a top window 118, side doors 119 and 120, as well as openings 123 for insertion of water, air or cables into the inner volume.

Preferably, housing units have a uniform cross section along a majority of a longest dimension of the unit. Such cross-sections may be based on polygons of three or more edges, or curved cross-sections as well as combination of polygons with one or more curved edge. Exemplary outlines of a uniform cross section are presented in FIG. 2. FIG. 2*a*, FIG. 2*b*, FIG. 2*c*, FIG. 2*d*, FIG. 2*e* and FIG. 2*f* show cross sections 210,220,230,240,250, and 260 having respectively triangular, rectangular, circular arc, trapezoidal, pentagonal, and hexagonal outlines. Preferably, circular arc 230 includes an arc of 120° to 300°, most preferably, 180° to 280°.

FIG. 3 includes exemplary cross-sections based on different types of common arcs. FIG. 3*a* illustrates an housing unit 310 having an hyperbolic arc uniform cross section 320. Such a cross section is known in the art for providing extra strength.

Figure 3A:
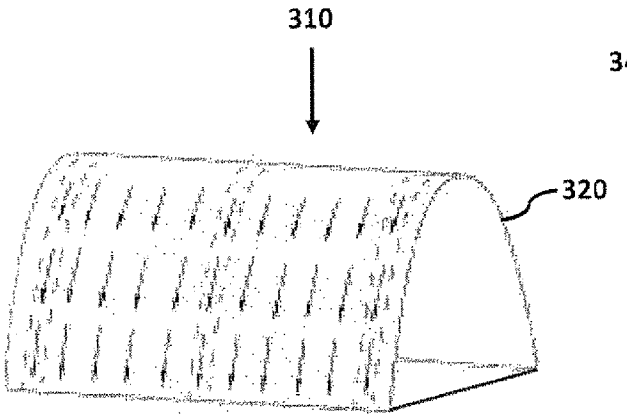
FIG. 3*a* illustrates an housing unit having a uniform cross section of hyperbolic arc shape.
Figure 3B:
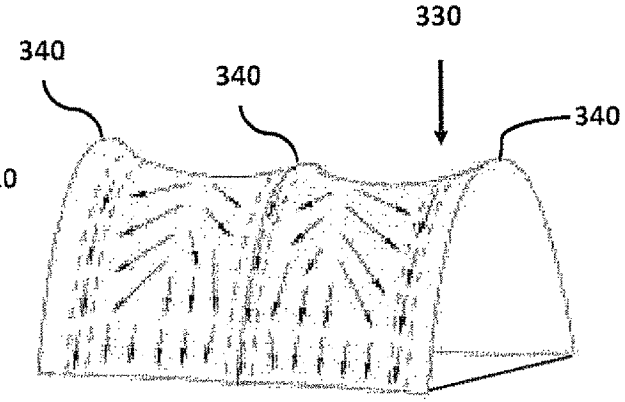
FIG. 3*b* illustrates an housing unit having a transversely supported hyperbolic arc cross section.
Figure 3C:
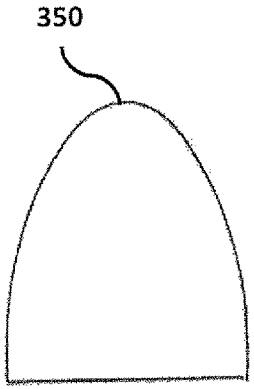
FIG. 3*c* depicts a parabolic arc shaped cross section of an housing unit.
Figure 3D:
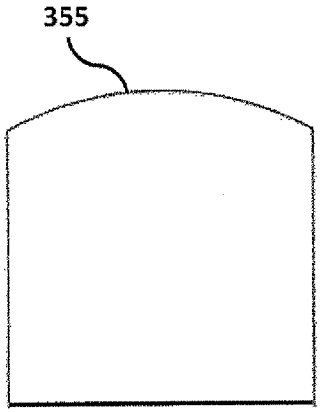
FIG. 3*d* illustrates a segmental arch shaped cross section of an housing unit.
Figure 3E:
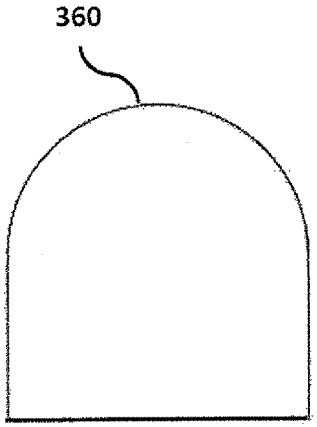
FIG. 3*e* illustrates a semi-circular arch shaped cross section of an housing unit.
Figure 3F:
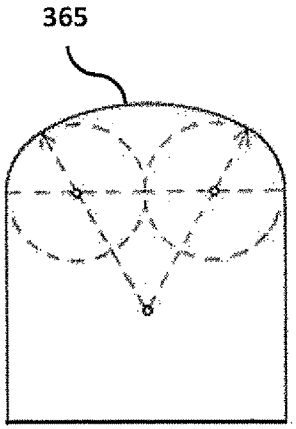
FIG. 3*f* illustrates a three-centered arch shaped cross section of an housing unit.
Figure 3H:
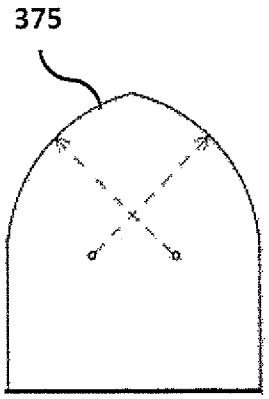
FIG. 3*h* illustrates a drop arch shaped cross section of an housing unit.
Figure 3J:
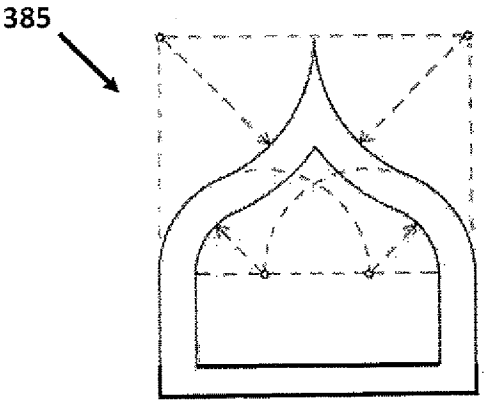
FIG. 3*j* illustrates an Ogee arch shaped cross section of an housing unit.
Figure 3G:
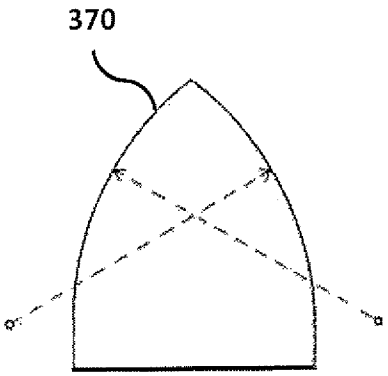
FIG. 3*g* illustrates a pointed (or Lancet) arch shaped cross section of an housing unit.
Figure 3I:
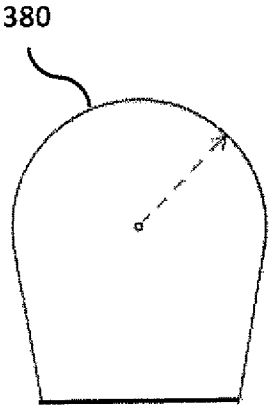
FIG. 3*i* illustrates a horseshoe arch shaped cross section of an housing unit.

Giving up the uniform cross section and the high level of packing density it provides, an housing unit 330 having several transverse supports 340 and hyperbolic arc cross section may be designed as depicted in FIG. 3*b*.

Also, FIGS. 3*c*, 3*d*, 3*e*, 3*f*, 3*g*, 3*h*, 3*i* and 3*j*, show the following respective arc-like uniform cross-sections, a parabolic arc—350, a segmental arch—355, a semi-circular arch—360, a three-centered arch—365, a pointed or Lancet arch—370, a drop arch—375, a horseshoe arch—380 and an Ogee arch—385.

The thickness of an external shell of an housing unit over a majority of its external shell is between 1 mm and 50 mm, preferably between 2 mm and 20 mm, and most preferably between 2 mm and 6 mm.

Figure 5A:
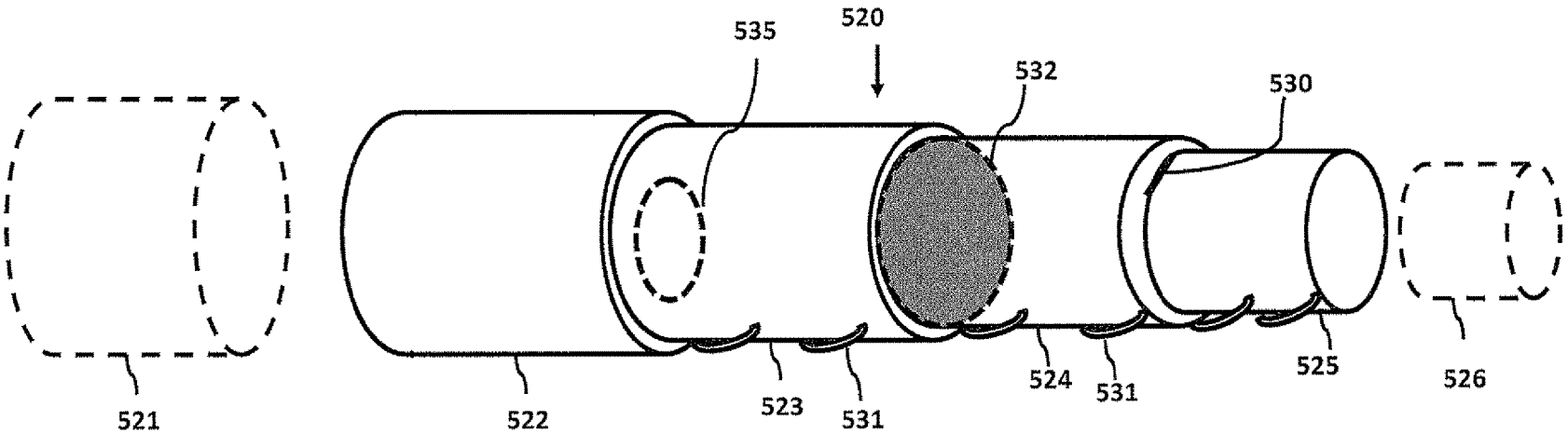
FIG. 5*a* presents a deployed series of housing units having four connected units forming a combined usable volume or living facility, formed by the internal volumes of the connected units.
Figure 5B:
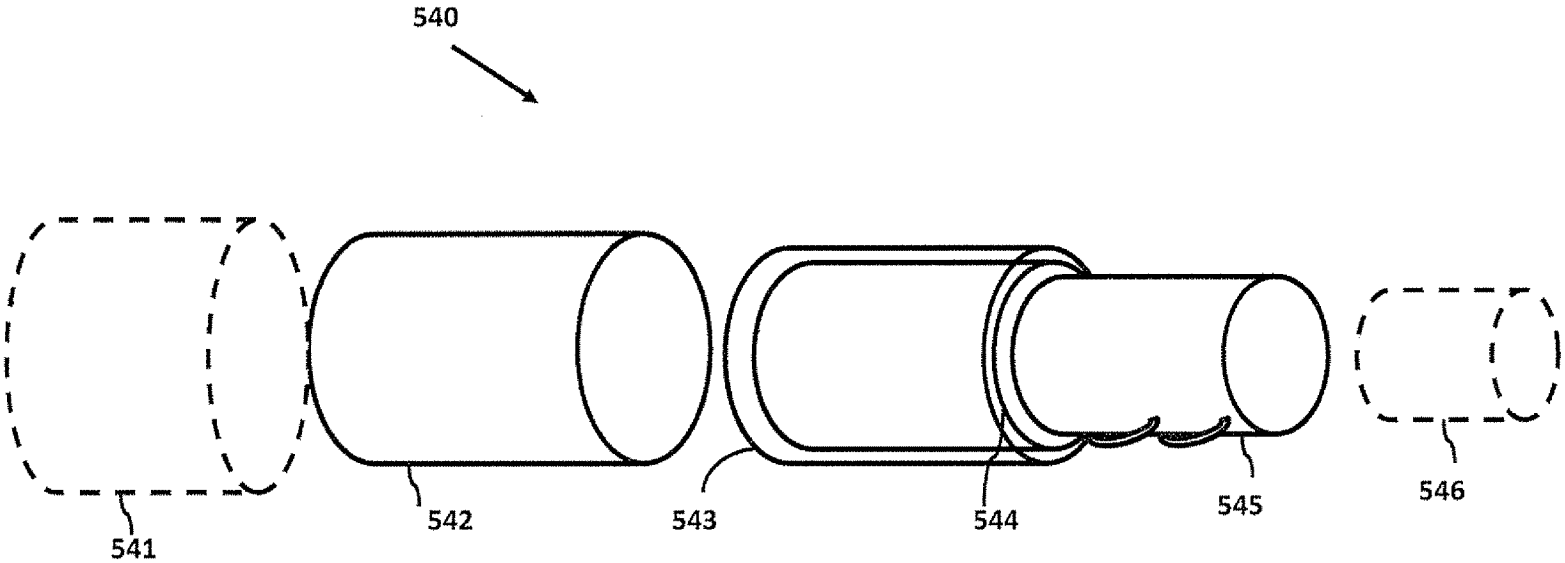
FIG. 5*b* depicts a deployed series of housing units having two combined housing units in connection to a third housing unit which together form a long housing facility, and three independent housing units.
Figure 6:
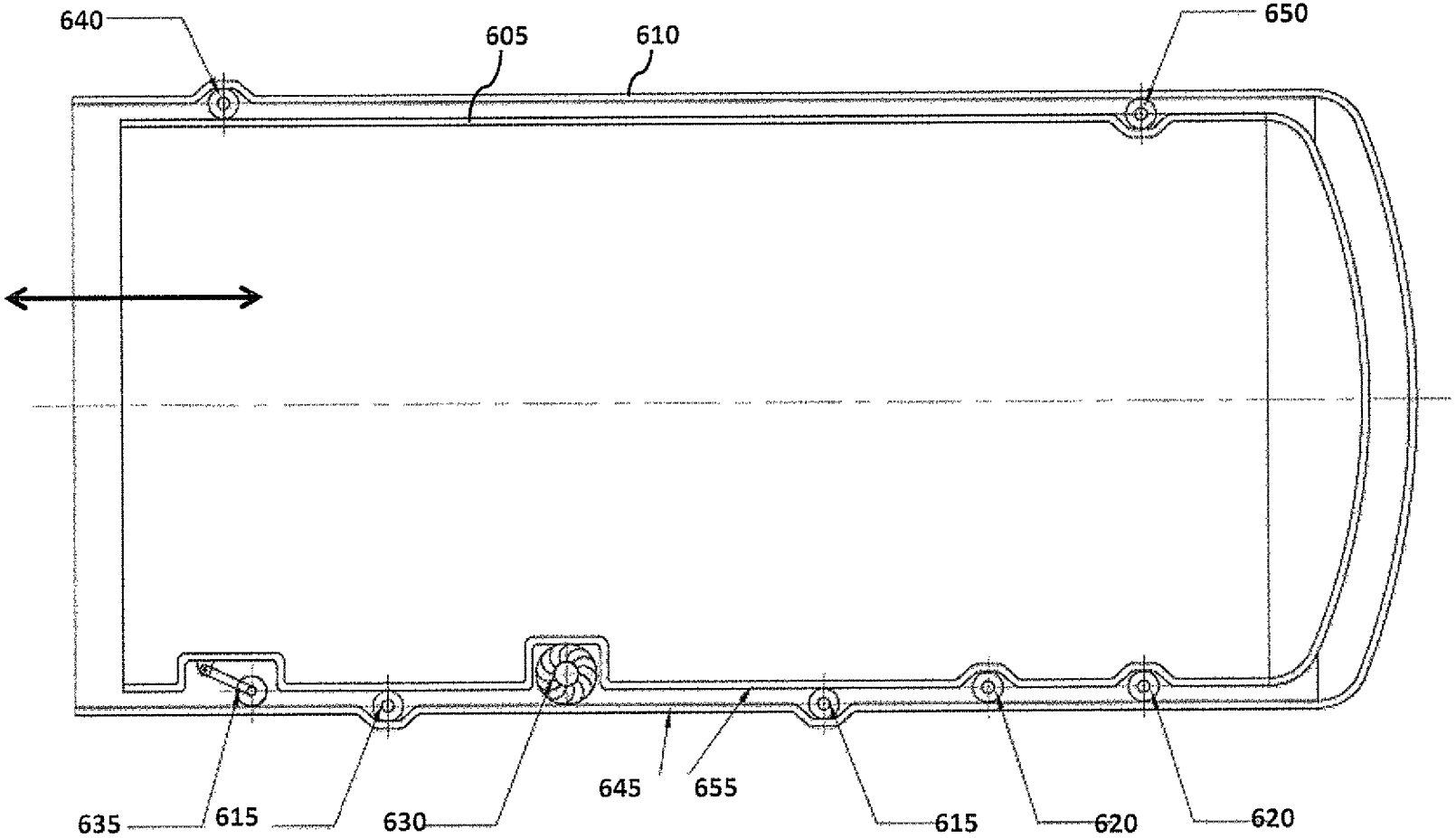
FIG. 6 presents an internal housing unit within an associated external unit having a variety of displacement means to facilitate the displacement of the internal housing unit out and into the external housing unit.

Unpacking and Deployment (FIGS. 4-6)

Figure 4A:
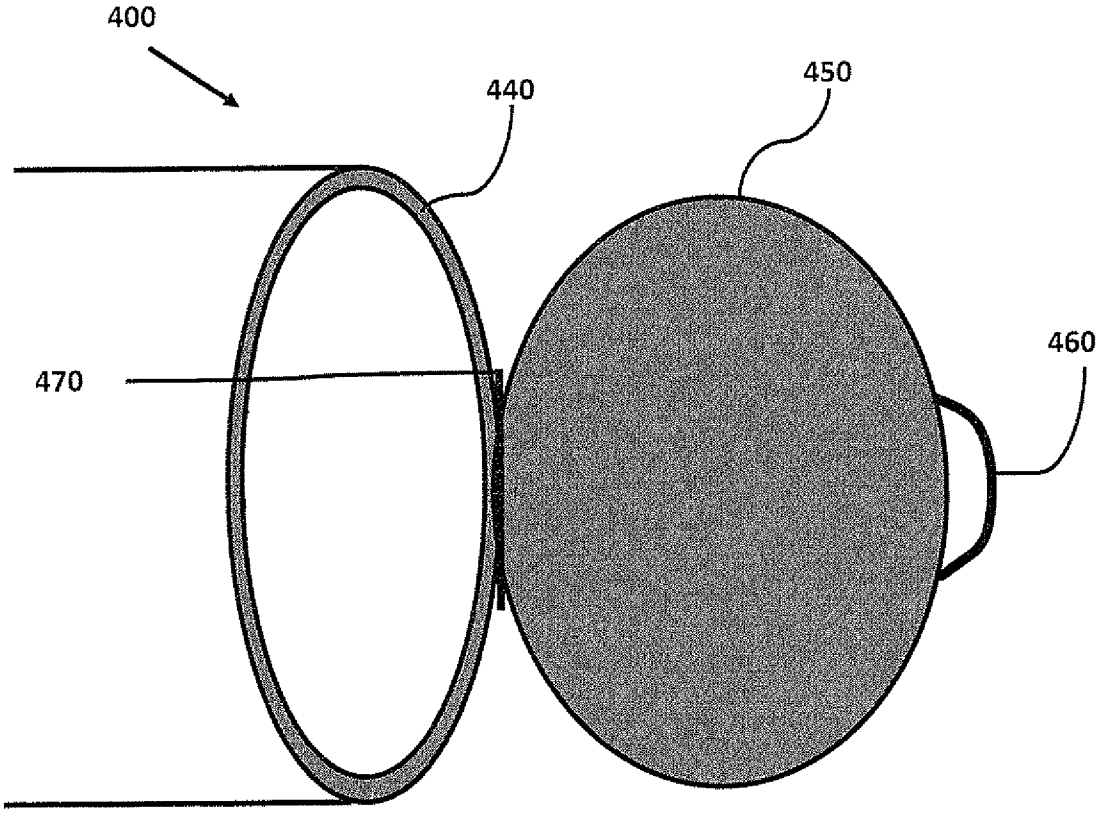
FIG. 4*a* shows an housing unit having a door.

FIG. 4*a* shows an housing unit 400 having a door 450, which couples to a shell 440 for closing housing unit 400. Door 450 is opened and closed using an handle 460. The position of door axis 470 on shell 440 leaves adequately large clear-aperture for the insertion or removal of an associated internal housing unit. Caps 111, 112 and 113 of a different design of a opening cover are shown in FIG. 1*b*. For the opposing side of the housing unit, a cap 114 (of FIG. 1*c*) closes or seals the housing unit during transportation and use.

Figure 4B:
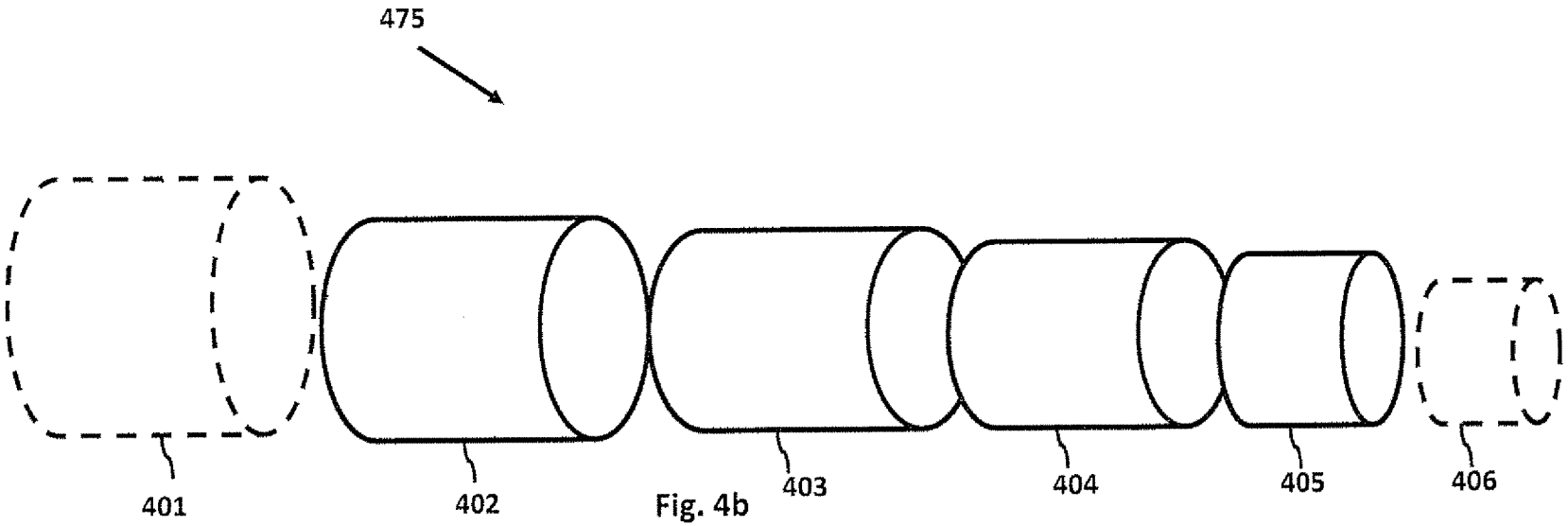
FIG. 4*b* presents a fully deployed series of housing units.

A full deployment of a series 475 of housing units 401,402,403,404, 405 and 406 is shown in FIG. 4*b*. All deployed units are independently deployed so that each one of them is put in place with its integrated cups, openings and all internal modules and components in accordance with the specific application.

Figure 4C:
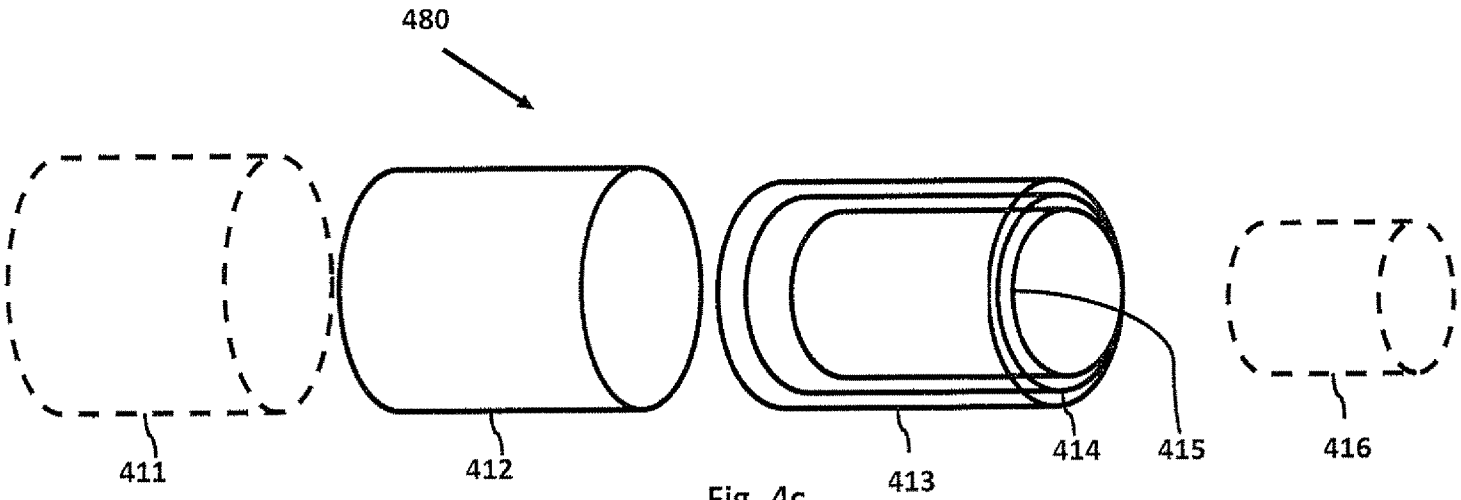
FIG. 4*c* shows a deployed series of housing units where three housing units remain combined either for a better environmental protection, or when the displacement of the internal units shown is not required for a specific deployment of the series.

Rather than full deployment, a partial deployment may be designed in advance or decided during the deployment, as shown in FIG. 4*c* where series 480 of housing units 411,412, 413, 414,415 and 416 is partially deployed. Units 413,414 and 415 are left together such that a combined living chamber is created with a at least a triple layer shell consisting the shells of three units 413,414 and 415, and intermediate layers between them, if disposed there in the packing process.

If designed in advance, an intermediate layer such as 177 (see FIG. 1*a*) is disposed between a certain external housing unit and an associated internal housing unit. Upon deployment of the series, the certain external housing unit and the associated internal housing unit remain together such as to have a combined housing unit having a shell of at least three layers, the shell of the external unit, the buffer layer, and the shell of the internal unit. Such arrangements might provide better environmental protection.

Another useful deploying arrangement is depicted in FIG. 5*a* for series of housing units 521,522,523,524,525 and 526. Internal unit 523 is displaced out of unit 522 but remains connected to unit 522 in its edge. Similarly, units 524 and 525 are displaced out of units 523 and 524, respectively, but remain connected to the associate unit at the edge. Thus, a long living facility 520 is created as a telescopic chain of units, for tasks requiring relatively larger volumes and connectable yet separable spaces, such as field hospital. Passageways like 535 and doors like 532 enable division of the long facility in accordance with the functional needs of the facility. Such opening between units may be closed by sliding covers on the wall containing them. Alternatively, the open-able covers of windows, doors and other open-able components are installed only on the outermost and/or innermost elements of such long facility, keeping the openings on walls of all other elements either opened, for usable opening, or sealed, for non usable opening, until a unit is fully or partially released from the facility.

Long facility 520 is sealable using stoppers 530 and sealing components at the interface of adjacent units. A stopper 530 may be either an integral part of an housing unit, or an additional component installed at the interface of two housing units as part of the deployment process. Due to difference in external diameter of the housing units 522,523, 524 and 525, spacers 531 under units 523,524 and 525 are used for equal leveling of the respective housing units. Spacers 531 may be installed on-site or be integral parts of either the external housing unit or the associated housing unit. Also, displacement means as described below may have a second task as leveling means.

Referring now to FIG. 5*b*, deployment examples of FIGS. 4*b*, 4*c* and 5*a* are used in combination, whereas series 540 is deployed such that units 541, 542 and 546 are deployed as independent units, housing unit 544 remains within housing unit 543, and unit 545 is pulled out of unit 544 to form a connected space of a single facility.

For displacing an internal unit 605 out of an external unit 610, a plurality of means may be used, as shown in FIG. 6. Integrated bearings 615 and 640 may be installed on the inner side of external housing unit 610. Alternatively, integrated bearings 620 and 650 may be installed on the outer side of internal housing unit 605. The integrated bearings 615, 640 or 620, 650 may be either spherical or cylindrical. Other displacement accessory is a set of fixed integrated wheels 630 on the outer side of internal unit 605 or a set of retractable wheels 635 on the outer side of internal unit 605. In addition, a low friction coating (e.g. Teflon-like materials) may coat surface 645 of the inner side of external unit 610, and/or surface 655 of the surface of the outer side of internal housing unit 605. Displacing an internal unit relative to its associated external unit, when majority of the internal unit is extracted out of the external one, and loading any housing unit, may be assisted by utilizing a tray 110 (FIG. 1*a*) which may contain spherical or cylindrical bearings or wheels for minimizing the friction between the elements that are pushed into or pulled out of the elements containing them. Sliding tray 110 may be either completely internal and integral to the bottom part of a containing element, (e.g. installed as part of its bottom surface), or it can be a combination of internal part and retractable external module, as shown in FIG. 1*a*. As all elements can be independently used and also contain internal cargo, sliding tray 110 and its bearing system may be designed to become an integral part of all of the series' elements for assisting all up/downloading procedures.

Transportability

The transportability of the series of densely packed housing units is clarified using several examples. In a first example, the design is based on a single wall cylindrical. FRP (fiberglass reinforced polymer) tanks, the kind used for underground liquid storage tanks for deploying under up to 3 m soil cover. The outermost element or housing unit has a 3 m diameter and a length of about 8 m. The series includes up to 12 elements wherein the innermost element has almost the same length as the outermost and its diameter is about 2.5 m. The total weight of the entire 12-unit system is less than 15 tons, which is transportable by standard double-axe trucks. Such system can be deployed, according to the mode shown in FIG. 4*b*, as a chain of 13 individual housing units that can be used as protected living facilities, including sleeping arrangements, for 6-16 adults per unit, depending on internal architectural set-up, a total of 80-200 adults. The truck may also carry the internal modules of the structures, packable internal to the innermost element or/and outside the outermost unit.

In a second case, the same series may be deployed according to the mode described in FIG. 5*a*, to long protected structure of about 100 m total length. Such a facility may be used as hospitals, schools etc.

In a third example, the series is used for either harsh environment in which temperatures can drop to sub-zero range, or at war/stormy zones wherein the elements should be protected against light projectiles. The deployment is based on a series of double-wall elements that include the required protection layers between their internal and external walls or mounted on the inside shell of a relevant unit. A six unit series, for example, is based on a 3" sealable protection layers between a double-wall configuration of each element, wherein the outermost and innermost elements have the same external size as the units of the first example. The series is deployed as a six facility setup, generating either living facilities for 30-90 adults or about 50 m long public structure, having six separate connectable spaces.

Alternatively, if the series is used unpacked or dismantled to two or three integrated subsystems, the total usable living facilities drops by a factor of about two or three, respectively. However, the protection level of the inner spaces rises sharply utilizing buffering materials having total thickness of 9" or 6", respectively. Also, novel nano materials insulating layers (e.g. Aerogel insulating carpets, produced by Aspen Aerogel nanotechnologies) of few (up to 10) millimeters may be used as an internal spacing material within a double wall unit. The provided nano-material insulation is equivalent to walls having conventional 2"-3" thick insulating materials. Thus, by reducing overall wall thickness, the use of nano-materials significantly increases the number of elements that are packable into a given outermost unit.

It is noted that utilizing heavy trucks for deploying the series enables designing heavier multi-element systems having a total cargo weight of over 30 tons. Such designs enables wider size of the outermost unit such as to include up to 20 housing units per series, packaging of all the components and modules of the deployable elements internal to the innermost element, and transporting two independent series as shown in former examples on a single truck.

Figure 7:
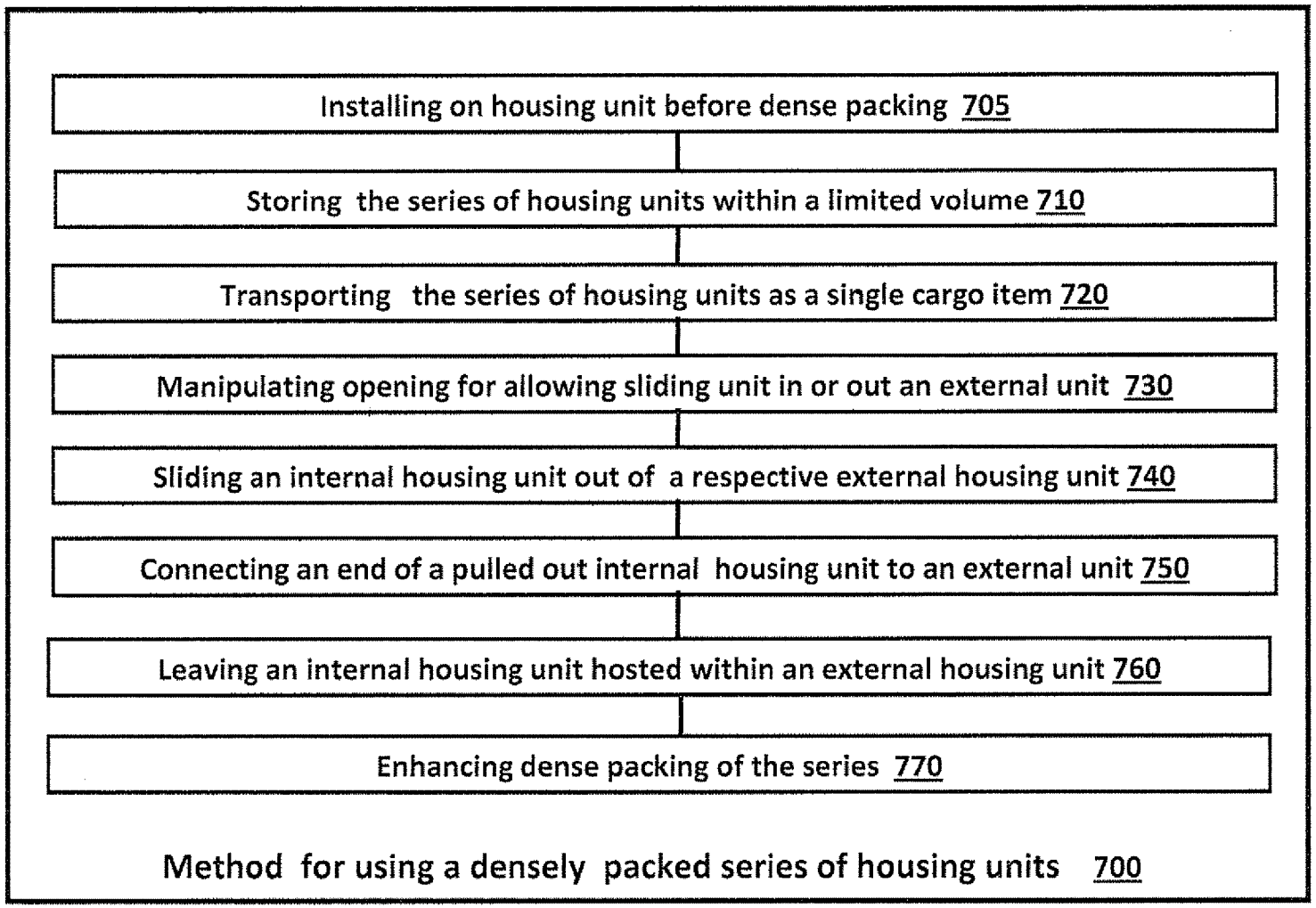
FIG. 7 is a flow chart of a method for using a densely packed series of housing unit.
Figure 8:
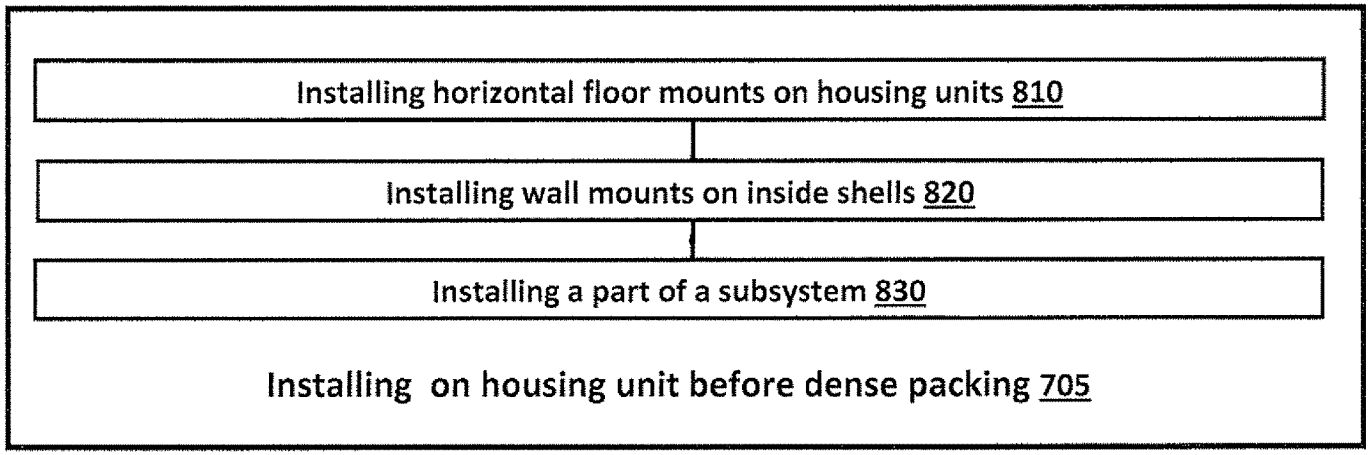
FIG. 8 lists steps for installment on housing unit before dense packing of the series.
Figure 9:
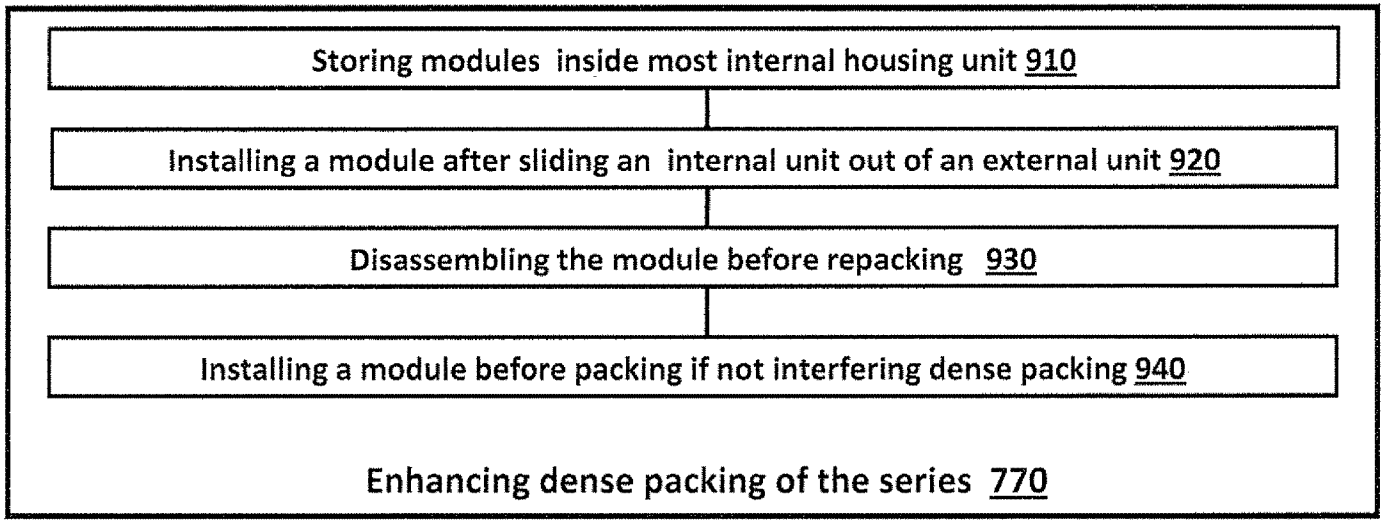
FIG. 9 lists steps for enhancing dense packing of the series.

In some embodiments, the length of a most external housing unit is between 6 m and 12 m, preferably, between 6 m and 9 m, and its width is between 2.5 m and 8 m, preferably between 3 m and 4 m, for avoiding the need for complicated trucking on conventional roads A Method for Using a Series of Housing Units (FIGS. 7,8,9)

Before presenting a method for using a series of housing units, it is noted that the steps of the method may be performed in any order or simultaneously, unless it is clear from the context that one step depends on another being performed first. FIG. 7 is a flow chart of a method 700 for using a densely packed sequential series 100 of external housing units associated with succeeding internal housing units. The method includes a step 705 of installing a variety of articles on the housing units before packing them compactly, a step 710 of storing the series such that the volume accommodated by the series has substantially the same size as a storage volume required for accommodating a most external unit of the series, and a step 720 of transporting the series as a single cargo item from a certain location to a destined location. Method 700 also includes step 730 of manipulating openings for allowing displacing of internal housing units relative to associated external units, and a step 740 of displacing or sliding the internal housing units from the associated external housing units, such that the inside volume of the at least one external units being available for activities other than storing the internal housing units.

In some embodiments, method 700 includes a step 750 of connecting an internal housing unit to an associated external housing unit after a major part of a length of the internal unit is displaced out of the associated external housing unit. The connection may be a sealable connection isolating a combined volume of the connected housing units from external environment. The connection may include an opening or a door in a first housing unit for connection with a second housing unit. Also, a blocking means may exist between internal volume of an internal housing unit and the associated external unit.

In some embodiments, method 700 includes a step 760 of leaving an internal housing unit enclosed within an external housing unit, and a step 770 of enhancing dense packing of the series.

The installing steps 705 before dense packing, are outlined in FIG. 8 and include installment 810 of horizontal floor mounts on an inside shell of an housing unit such as to allow installment of a floor therein, installment 820 of wall mounts on an inside shell of the certain housing unit for assembling surfaces on the inner shell, and installment 830 of parts of a variety of subsystems.

As depicted in FIG. 9, the dense packing is further enhanced by a step 910 of storing inside a most internal housing unit modules for installing on the housing units after deployment, a step 920 of installing a module on a certain housing unit after the displacing, a step 930 of disassembling the module to allow dense repacking of the certain housing unit with another housing unit, and a step 940 of installing a module on a certain housing unit before packing, provided that it does not interfere the dense packing of the series.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. In particular, the present invention is not limited in any way by the examples described.

The invention claimed is:

1. A densely packable sequential series of housing units comprising:

at least one external housing unit and at least one internal housing unit comprising distinct and independently deployable structures, the at least one external housing unit and the at least one internal housing unit configurable into a packed orientation, where at least a substantial portion of the at least one internal housing unit is received in the at least one external housing unit, and, the at least one internal housing unit is both: 1) movable within the at least one external housing unit, to a position where a housing structure with at least two sealable spaces is provided; and 2) separable from the at least one external housing unit upon deployment from the packed orientation to an unpacked orientation, such that the at least one internal housing unit is combinable with the at least one external housing unit to form a combined housing structure, or completely separable from the at least one external housing unit to define a separate housing structure from the at least one external housing unit.

2. The series of claim 1, including at least one intermediate housing unit serving both as an internal unit associated with a preceding external unit and as an external unit associated with a succeeding internal housing unit.

3. The series of claim 2, including at least two housing units intermediate the at least one external and the at least internal housing units.

4. The series of claim 1, wherein the at least one external housing unit has a uniform cross section along a majority of one of the dimensions of the external housing unit.

5. The series of claim 4, wherein the uniform cross section is selected from at least one shape of: (i) a substantially circular; (ii) substantially triangular; (iii) substantially rectangular; (iv) a substantially circular arc; (v) substantially trapezoidal; (vi) substantially polygonal including five or more edges; (vii) a substantially hyperbolic arc; (viii) a substantially parabolic arc; (ix) a substantially segmental arch; (x) a substantially semi-circular arch; (xi) a substantially three-centered arch; (xii) a substantially Lancet arch; (xiii) a substantially drop arch; (xiv) a substantially horseshoe arch; and, (xv) a substantially Ogee arch.

6. The series of claim 4, wherein (i) the at least one external housing unit has a first uniform cross section along a majority of one of the dimensions of said at least one external housing unit; (ii) the at least one internal housing unit associated with the at least one external housing unit has a second uniform cross section along a majority of a one of the dimensions of the at least one internal housing unit; (iii) said second uniform cross section is substantially similar in shape to said first uniform cross section; and, (iv) a linear scale of said second uniform cross section is 30% to 99.5% of a respective linear scale of said first uniform cross section.

7. The series of claim 1, wherein the series is transportable as a single cargo item from a certain location to a desired deploying location.

8. The series of claim 1, wherein each of at least one internal housing unit and the at least one external housing unit includes a shell including at least one layer to form a single or multi-layer shell design including at least one out of:

(i) a composite material including at least one of:
  (A) fiberglass reinforced plastic;
  (B) polymer-metal composite; and,
  (C) carbon based composite materials;
(ii) insulation; and,
(iii) anti-ballistic material.

9. The series of claim 8, wherein the shell of each of the at least one external housing unit and the at least one internal housing unit includes at least one sealable openings for providing internal conditions to each of the at least two spaces defined by the at least one internal housing unit at least partially within the at least one external housing unit, at predetermined environmental conditions.

10. The series of claim 8, wherein the shell of each of the at least one external housing unit and internal housing unit includes at least one mount, the at least one mount is installed on the shell, such as to not interfere the dense packing of the series, said at least one mount is selected from a group of mounts consisting of:

(i) horizontal floor mounts installed on an inside shell such as to allow installment of a floor in at least one of the at least one internal housing unit and the at least one external housing unit;

(ii) wall mounts installed on a shell of said at least one of the at least one internal housing unit and the at least one external housing unit for assembling one or more surfaces on said shell, the surfaces selected from a group of surfaces consisting of:

(A) thermal insulating surfaces;

(B) armored surfaces;

(C) acoustic isolating surfaces;

(D) power generating surfaces; and, (E) surfaces customized for storage;

(iii) a wall mount for a power source;

(iv) a wall mount for a power control system;

(v) a wall mount for an air condition system;

(vi) a wall mount for a temperature control system;

(vii) a wall mount for humidity control system (viii) a wall mount for furniture; and, (ix) a wall mount for means for isolating an internal space of the at least one external housing unit from an internal space of the at least one internal housing unit, when the at least one external housing unit is adjacent thereto.

11. The series of claim 1, wherein the at least one external housing unit has a door configured for receiving and displacing the at least one internal housing unit.

12. The series of claim 1, wherein at least one intermediate layer is disposed between the at least one external housing unit and the at least one internal housing unit, thereby upon deployment of the series said the at least one external housing unit and the at least one internal housing unit remain together such as to have a combined housing unit including a shell of at least three layers.

13. The series of claim 1, additionally comprising: means for facilitating the displacement of the at least one internal housing unit relative to the at least one external housing unit.

14. The series of claim 13, wherein said means for facilitating the displacement includes, at least one displacement facilitating means selected from a group of displacement facilitating means consisting of: (i) means installed on the exterior of the at least one internal housing unit for supporting external means participating in the displacement process; (ii) means installed on the interior of the at least one external housing unit; (iii) means installed on the exterior of the at least one internal housing unit; (iv) integrated bearings; (v) integrated wheels; (vi) a set of integrated retractable wheels; and, (vii) a low friction coating.

15. A method for using a densely packable sequential series of housing units comprising:

providing at least one external housing unit and at least one internal housing unit comprising distinct and independently deployable structures, the at least one external housing unit and the at least one internal housing unit configurable into a packed orientation, where at least a substantial portion of the at least one internal housing unit is received in the at least one external housing unit, and, the at least one internal housing unit is both: 1) movable within the at least one external housing unit, to a position where a housing structure with at least two sealable spaces is provided; and 2) separable from the at least one external housing unit upon deployment from the packed orientation to an unpacked orientation, such that the at least one internal housing unit is combinable with the at least one external housing unit to form a combined housing structure, or completely separable from the at least one external housing unit to define a separate housing structure from the at least one external housing unit; and, deploying the series at a location to be used either of the packed or unpacked orientations.

16. The method of claim 15, wherein the at least one external housing unit includes means for supporting the displacement of the at least one internal housing unit over an inside bottom of the at least one external housing unit.

17. The method of claim 15, wherein the deploying includes connecting the at least one internal housing unit to the at least one external housing unit after a major part of a length of said at least one internal unit is displaced out of said at least one external housing unit.

18. The method of claim 17, wherein the connecting of the at least one external housing unit and at least one internal housing unit has at least one feature of a group of features selected from at least one of (i) including at least one opening of the at least one first housing unit for connection with the at least one second housing unit; (ii) being a sealable connection isolating a combined volume of the connected at least one first and second housing units from external environment; (iii) including a door between said at least one internal housing unit and said at least one external housing unit; and (iv) being associated with a blocking means between internal volume of said at least one internal housing unit and said at least one external housing unit.

19. The method of claim 15, wherein the deploying includes moving a substantial portion of at least one internal housing unit within the at least one external housing unit, to provide the at least two sealable spaces.

20. The method of claim 15, wherein the deploying optionally includes separating the at least one external housing unit from the at least one internal housing unit, such that: 1) the at least one external housing unit is oriented with respect to the at least one internal housing unit so as to be joined together, or, 2) the at least one external housing unit remains independently separate from the at least one internal housing unit.

* * * * *